US010233667B1

(12) United States Patent
Frenette

(10) Patent No.: US 10,233,667 B1
(45) Date of Patent: Mar. 19, 2019

(54) TEMPORARY BARRIER POST

(71) Applicant: Albert E. Frenette, Hudson, NH (US)

(72) Inventor: Albert E. Frenette, Hudson, NH (US)

( * ) Notice: Subject to any disclaimer, the term of this patent is extended or adjusted under 35 U.S.C. 154(b) by 0 days.

(21) Appl. No.: 16/008,487

(22) Filed: Jun. 14, 2018

(51) Int. Cl.
*E04H 17/22* (2006.01)
*E04H 12/20* (2006.01)
*E04H 12/34* (2006.01)

(52) U.S. Cl.
CPC ..... *E04H 17/22* (2013.01); *E04H 12/20* (2013.01); *E04H 12/347* (2013.01)

(58) Field of Classification Search
CPC ..... E04H 17/22; E04H 12/20; E04H 12/347
USPC ..... 52/854
See application file for complete search history.

(56) References Cited

U.S. PATENT DOCUMENTS 4,705,262 A * 11/1987 Roberts ..... E04H 17/26 254/263
5,899,171 A * 5/1999 Abrahamson ..... A01K 3/00 119/512
9,447,599 B1 * 9/2016 Parent ..... E04H 12/2223
9,732,540 B1 * 8/2017 Jansen ..... E04H 17/22
2009/0152429 A1 * 6/2009 West ..... E04H 17/22 248/351
2012/0104190 A1 * 5/2012 Parent ..... A47G 29/1216 248/121
2013/0227897 A1 * 9/2013 Palmer ..... E02D 27/42 52/157
2013/0256619 A1 * 10/2013 Bailey ..... E04H 17/08 256/35
2014/0311083 A1 * 10/2014 Madril ..... E04H 12/347 52/741.14
2016/0305152 A1 * 10/2016 Kozyra ..... E04H 17/22
2017/0016243 A1 * 1/2017 Testa ..... E04H 12/2261
2017/0175384 A1 * 6/2017 Bergman ..... E04B 1/486
2017/0350159 A1 * 12/2017 Tuthill ..... A01K 1/0005
2018/0258603 A1 * 9/2018 Zhang ..... E02D 7/04

* cited by examiner

*Primary Examiner* — Paola Agudelo
(74) *Attorney, Agent, or Firm* — Davis & Bujold PLLC

(57) ABSTRACT

A temporary barrier post having a main pole, adjustable post, and bracing shaft. A joint assembly is supported on and can slide axially along the main pole. An end of the adjustable post is connected to the joint assembly such that the adjustable post can rotate relative to the joint assembly. A coupler is fixed to the adjustable post axially between the proximate and remote ends such that the bracing shaft is pivotally connected to the adjustable post. The temporary barrier post is adjustable between an expanded condition, in which the adjustable post extends laterally relative to the main pole, the bracing shaft is oblique relative to the adjustable post, and the adjustable post and the bracing shaft retain the main pole in a set location via the joint assembly, and a collapsed condition, in which the main pole, the adjustable post, and the bracing shaft are parallel.

16 Claims, 5 Drawing Sheets

Fig. 2
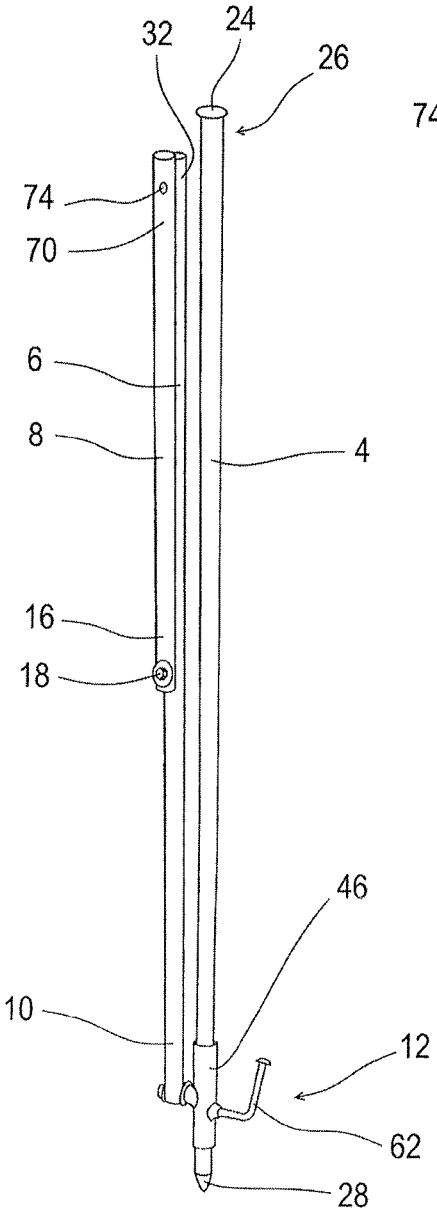
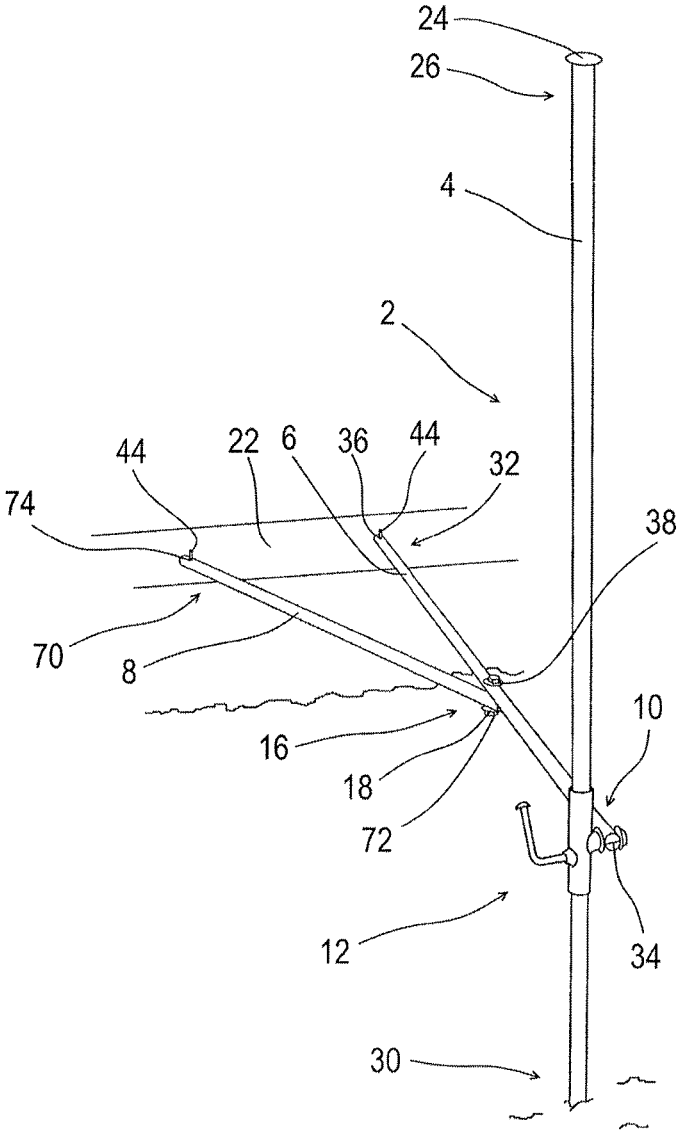
Fig. 1

Fig. 3
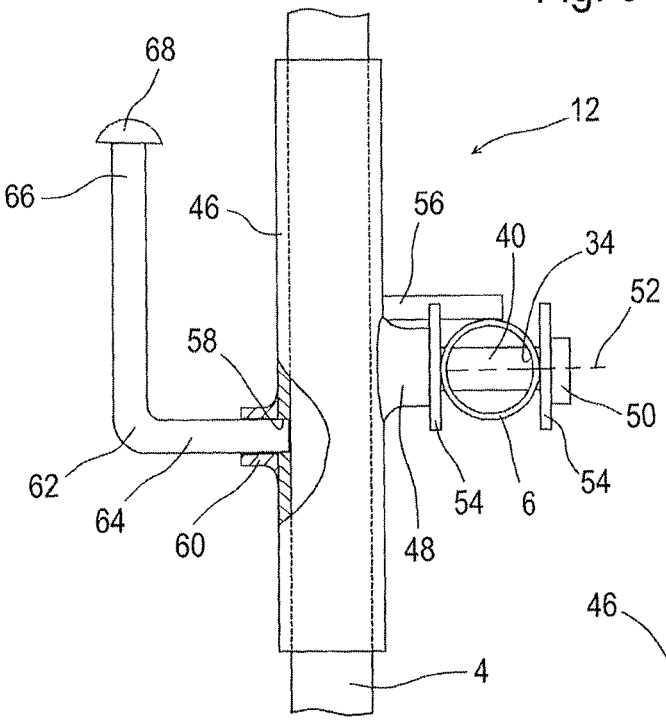
Fig. 4
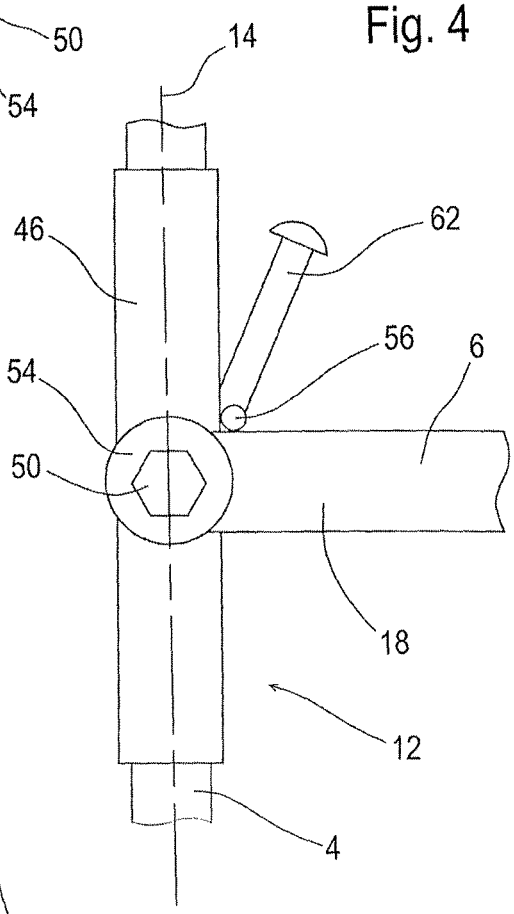
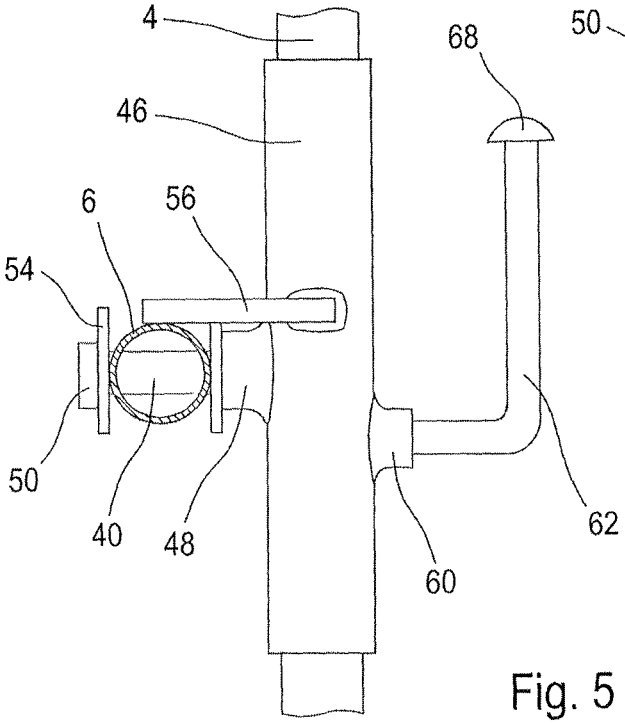
Fig. 5

TEMPORARY BARRIER POST

FIELD OF THE INVENTION

The present invention relates to a temporary barrier post and a system of temporary barrier posts for forming and/or supporting a temporary visual perimeter which identifies work-safety zones.

BACKGROUND OF THE INVENTION

A number of temporary barriers are known in the art which are utilized to identify and restrict access to potentially hazardous areas such as excavations, construction zones and other such job sites. For the safety and welfare of workers at such job sites, the Occupational Safety and Health Administration (OSHA) has issued safety standards regarding perimeters or rather control lines around hazardous areas. For example, in the beginning stages of building construction, contractors are required to install a perimeter around open foundations prior the construction of the building in order to protect against falls. Such perimeters or control lines serve to, at least, visually warn people of the presence of the foundation and the abrupt drop from the level of the ground outside the foundation walls to level of the surface within the foundation wall, e.g., the floor of a basement. These perimeters or control lines are often required to have a certain height so as to be obvious and easily identifiable as a barrier. They are also required to be positioned at a minimum distance away from the edge of the foundation in order to provide a margin of safety for someone walking along the perimeter.

Many known barriers include stanchions to which perimeters or control lines are attached. Generally these stanchions have a base in the form of a tripod or that is weighted such that the stanchions are supported or held upright. These types of bases help to stabilize the stanchions while at the same time holding them vertically relative to the surface on which they are arranged. Often times brightly colored, fluorescent and/or reflective safety tape, e.g., "signaling means" is attached to and extends between the stanchions which surround the potentially hazardous site. In other cases, a flexible rope, line or wire is secured to and extends between the stanchions and highly visible signaling means, safety flags or signs are attached to the rope at intervals along the perimeter or control line. Although such known stanchions do not require great effort to arrange and install, since they are generally free standing and relatively simple to move, often times they are moved, either inadvertently or purposefully, from their proscribed positions with respect to the edge of the hazardous site. For example, such free standing stanchions can be easily moved closer to the edge of the hazardous site, e.g., foundation, thereby creating a potentially unsafe situation and the possibility of being assessed a penalty or fine if the site is inspected by a regulatory official and it is found that the perimeter or control line fails to meet the minimum safety requirements.

SUMMARY OF THE INVENTION

Wherefore, it is an object of the present invention to overcome the above mentioned shortcomings and drawbacks associated with the prior art.

Another object of the present invention is to present a system of temporary barrier posts that can be easily assembled and arranged to form a safety perimeter or control line around a potentially hazardous area, object, structure or location thereby visually identifying such a potentially hazardous area, object, structure or location. The safety perimeter or control line can also be used to limit access to the potentially hazardous area, object, structure or location.

A further object of the present invention is to present a temporary visual perimeter which identifies work-safety zones such as an open foundation of a structure and which is formed by a plurality of temporary barrier posts that are easy to install or set up about the perimeter of the open foundation. The temporary barrier posts of the present invention are simply adjustable between an installed condition in which they used to form a safety perimeter or control line, and a collapsed condition in which the temporary barrier posts are generally stowed or put into storage.

Yet another object of the present invention is to provide a temporary barrier post which includes three individual poles, posts, shafts, rods, or bars that are connected to each other in such a way that their positions or arrangement with respect to each other can be changed or adjusted. For example in the installed condition, a first one of the poles, posts, shafts, rods, or bars is arrange in a generally vertical orientation while the other two of the poles, posts, shafts, rods, or bars extend in a generally horizontal orientation. Remote ends of the two horizontally oriented poles, posts, shafts, rods, or bars can be secured in position relative to the potentially hazardous area, e.g., open foundation thereby fixing the location of the vertically oriented first pole, post, shaft, rod, or bar. After a sufficient number of temporary barrier posts have been set up so as to surround the open foundation, highly visible signaling means, safety flags or signs are secured to and extend between the temporary barrier posts thereby forming the safety perimeter or control line. From the installed condition, the temporary barrier post can simply be adjusted to the collapsed condition by pivoting the two horizontally oriented poles, posts, shafts, rods, or bars so as to be at least substantially parallel to the first pole, post, shaft, rod, or bar. In the collapsed condition the overall profile of the temporary barrier post is greatly reduced so as to minimize the space for storing the temporary barrier post.

The present invention also relates to a temporary barrier post having a main pole, an adjustable post, and a bracing shaft. A joint assembly is supported on the main pole such that the joint assembly can slide axially along the main pole. A proximate end of the adjustable post is rotationally connected to the joint assembly such that the adjustable post can rotate with respect to the joint assembly. A coupler is fixed to the adjustable post axially between the proximate end of the adjustable post and a remote end of the adjustable post. A proximate end of the bracing shaft is connected, via the coupler, to the adjustable post such that the bracing shaft can pivot with respect to the adjustable post. The temporary barrier post is adjustable between an expanded condition and a collapsed condition. In the collapsed condition of the temporary barrier post, the main pole, the adjustable post, and the bracing shaft are at least substantially parallel to each other, and in the expanded condition of the temporary barrier post, the adjustable post extends laterally relative to the main pole, the bracing shaft is oblique relative to the adjustable post, and the adjustable post and the bracing shaft retain the main pole in a set location via the joint assembly.

The present invention also relates to a temporary barrier post that has a main pole, an adjustable post, and a bracing shaft. A joint assembly is supported on the main pole such that the joint assembly can axially slide along the main pole. A proximate end of the adjustable post is pivotably connected to the joint assembly such that the adjustable post can rotate with respect to the joint assembly. The joint assembly has a stay which releasably abuts the main pole and fixes the joint assembly along an axis of the main pole. The joint assembly has a stop which stops pivoting movement of the adjustable post relative to the joint assembly when the adjustable post is laterally arranged relative to the main pole. A coupler is fixed to the adjustable post axially between the proximate end of the adjustable post and a remote end of the adjustable post. A proximate end of the bracing shaft is connected, via the coupler, to the adjustable post such that the bracing shaft can pivot with respect to the adjustable post. The temporary barrier post can be adjusted between an expanded condition and a collapsed condition. In the collapsed condition of the temporary barrier post, the main pole, the adjustable post, and the bracing shaft are at least substantially parallel to each other. In the expanded condition of the temporary barrier post, the adjustable post abuts the stop and extends substantially perpendicular relative to the main pole and the bracing shaft is oblique relative to the adjustable post, and the adjustable post and the bracing shaft retaining the main pole in a set location via the joint assembly.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. The invention will now be described, by way of example, with reference to the accompanying drawings in which:

FIG. 1 is a perspective view of the temporary barrier post according to the invention in an expanded condition;

FIG. 2 is a perspective view of the temporary barrier post according to the invention in a collapsed condition;

FIG. 3 is a rear elevation view of a slidable pivoting joint assembly according to the invention;

FIG. 4 is a side elevation view of a slidable pivoting joint assembly according to the invention;

FIG. 5 is a front elevation view of a slidable pivoting joint assembly according to the invention;

It should be understood that the drawings are not necessarily to scale and that the disclosed embodiments are sometimes illustrated diagrammatical and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION OF THE PREFERRED EMBODIMENTS

The present invention will be understood by reference to the following detailed description, which should be read in conjunction with the appended drawings. It is to be appreciated that the following detailed description of various embodiments is by way of example only and is not meant to limit, in any way, the scope of the present invention.

Figure 11:
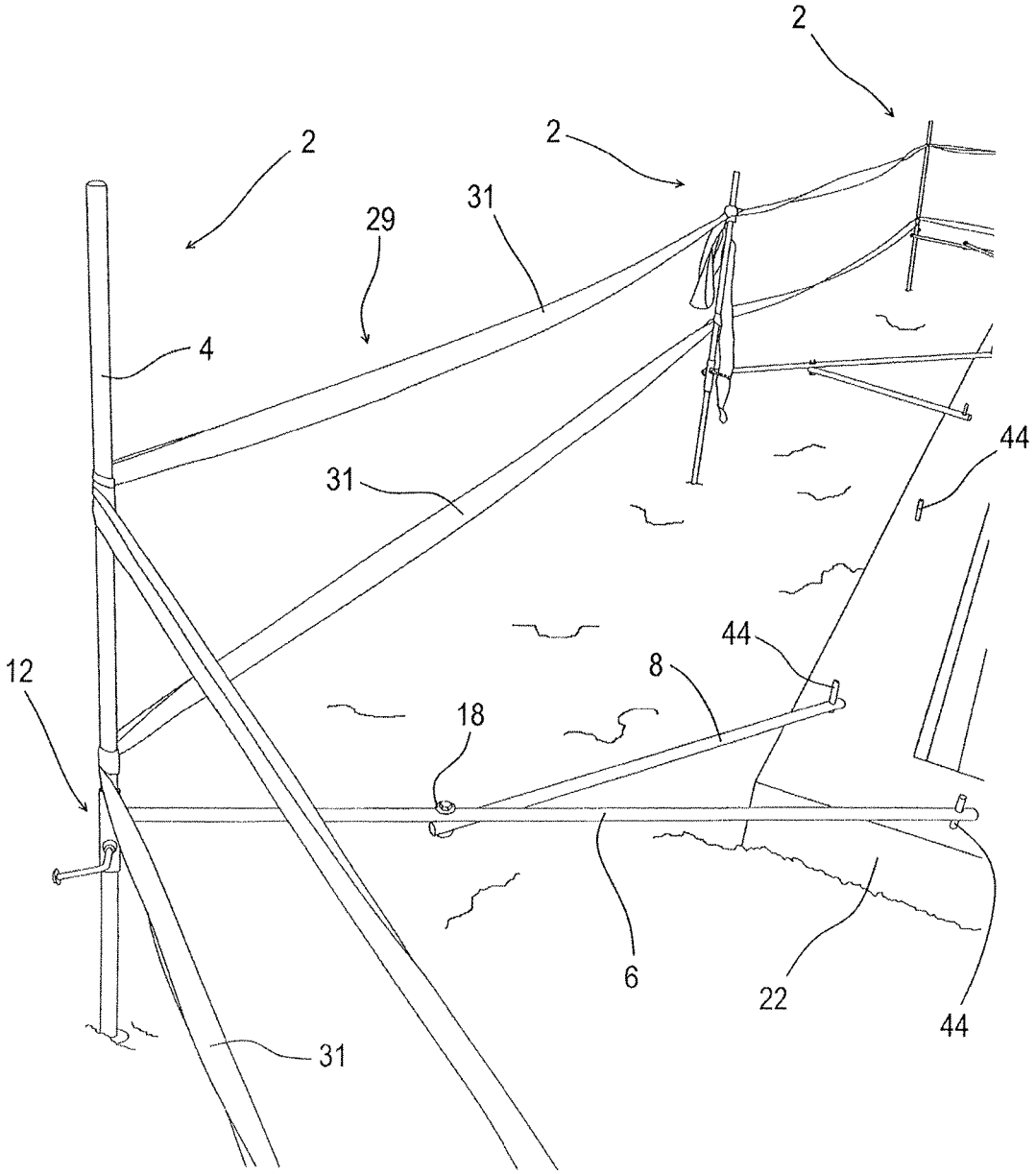
FIG. 11 is a pictorial view of a system of the temporary barrier post according to the invention installed along a foundation and forming, in part, a safety perimeter about the foundation.

Turning now to FIG. 1, a brief description concerning the various components of the present invention will now be briefly discussed. As can be seen in this embodiment, the present invention relates to a temporary barrier post and a system of temporary barrier posts which are used to form a safety perimeter or control line as shown in FIG. 11. It is to be understood that a safety perimeter or control line is generally formed by a system or rather a plurality of temporary barrier posts according the invention with highly visible signaling means, safety flags or signs secured to and extending between the individual temporary barrier posts. As each of the temporary barrier posts and the manner in which they are installed or set up is the same, for the sake of simplicity only single temporary barrier post will be described in detail below.

As shown in FIGS. 1 and 2, the temporary barrier post 2 is formed by three individual poles, posts, shafts, rods, or bars including a main pole 4, an adjustable post 6 and a bracing shaft 8. A proximate end 10 of the adjustable post 6 is coupled to the main pole 4 by means of a slidable, pivoting joint assembly 12. The pivoting joint assembly 12 enables the adjustable post 6 to be secured to the main pole 4 at different positions along the longitudinal axis 14 of the main pole 4 and allows the adjustable post 6 to be pivoted with respect to the main pole 4 in the manner to be discussed below. A proximate end 16 of the bracing shaft 8 is coupled to the adjustable post 6 by means of a fixed coupler 18 which secures the bracing shaft 8 at a point along a longitudinal axis 20 of the adjustable post 6 while at the same time allowing the bracing shaft 8 to be pivoted with respect to the adjustable post 6 in the manner described below. The pivoting joint assembly 12 and the fixed coupler 18 enable adjustment of the adjustable post 6 and the bracing shaft 8 in relation to the main pole 4 and each other such that the temporary barrier post 2 can be switched between an expanded or installed condition, as shown in FIG. 1, and a collapsed or stowed condition, as shown in FIG. 2. In the collapsed condition, the adjustable post 6 and the bracing shaft 8 are positioned so as to extend at least substantially parallel to the main pole 4 and each other thereby minimizing the amount of space needed to store the temporary barrier post 2 when not in use. To set up or form a safety perimeter or control line 29, the temporary barrier post 2 is changed from the collapsed condition to the expanded condition by pivoting and fixing the adjustable post 6 and the bracing shaft 8 relative to the main pole 4 and each other such that the temporary barrier post 2 can be secured in position at a desired distance away from the edge of a foundation wall 22.

The main pole 4 is formed from an elongate hollow pipe that has a flanged cap 24 secured at a head end 26 of the main pole 4 and a domed or pointed foot 28 that is secured at an opposite base end 30 of the main pole 4. The cap 24 and the foot 28 each close the respective base and head ends 30, 26 of the main pole 4 and help to prevent foreign matter, i.e., rain, dirt, sand and/or debris from entering the interior of main pole 4 which can possibly lead to accelerated deterioration or rusting of the main pole 4. It should be recognized however that the head and the base ends 26, 30 of the main pole 4 can be formed so as to be open. It should be appreciated that the main pole 4 and similarly the adjustable post 6 and bracing shaft 8 can be formed by solid poles, posts, shafts, rods, or bars, however making these components from solid members generally increases not only the overall weight of the temporary barrier post 2 but also the costs associated with production of the same. In use, i.e., with the temporary barrier post 2 in the expanded condition, the foot 28 is placed on the ground or a base surface and the main pole 4 generally stands vertically upward relative to the ground or base surface upon which the temporary barrier post 2 positioned, such that the head end 26 of the main pole 4 is directed upward. The foot 28 at the base end 30 of the main pole 4 is domed or pointed and contacts the ground upon which the temporary barrier post 2 is positioned so as to secure the base end 30 of the main pole 4 relative to the ground. The flanged cap 24 functions as a stop at the head end 26 of the main pole 4, that is to say the cap 24 prevents the pivoting joint assembly 12 from sliding off the head end 26 of the main pole 4 as well as helps to repel or direct water, e.g., rain from the head end 26. For this purpose, the cap 24 has a diameter that is preferably between about 0.875 inches to 2.5 inches or more preferably the diameter of the cap 24 is about 1.5 inches. It should be understood that the diameter of the cap 24 is generally at least as big as the diameter of the main pole 4, specifically the diameter of the main pole 4. Preferably the main pole 4 has an outside diameter that is between about 0.5 inches to 2.5 inches or more preferably the outside diameter of the main pole 4 is about 0.875 inches. It is to be recognized that the overall height or rather the axial length of the main pole 4 can depend on a number of factors including any official regulations regarding the height above the ground at which the safety perimeters or control lines 29, or more specifically the highly visible signaling means, safety tape, safety flags or signs 31 are to be located. Typically such signaling means 31 are to be located between a minimum of 36 inches above the ground and a maximum of 45 inches above the ground. Based on these requirements, the overall height or rather the axial length of the main pole 4 is preferably between about 36 inches to 78 inches or more preferably the overall height or rather the axial length of the main pole 4 is about 60 inches.

The adjustable post 6 is formed from an elongate hollow pipe and has a proximate end 10 and an opposite remote end 32. The proximate and remote ends 10, 32 of the adjustable post 6 are open, as shown in FIG. 3, however is to be understood that the proximate and remote ends 10, 32 of the adjustable post 6 can also be closed by end caps (not shown) for example so as to prevent or reduce foreign matter, i.e., rain, dirt, sand and/or debris from entering the interior of the adjustable post 6. Additionally as discussed above the adjustable post 6 can be formed from a solid pole, post, shaft, rod, or bar, however, in this case, it is to be appreciated that the drilling of three diametrical passages 34, 36, 38 through the adjustable post 6 may simplified if the adjustable post 6 is hollow. For example, if the adjustable post 6 is hollow, as shown in FIGS. 3 and 5, each of first, second and third diametrical passages 34, 36, 38 can be formed by drilling two concentric apertures on opposite sides of the adjustable post 6. The first diametrical passage 34 is located adjacent to the proximate end 10 of the adjustable post 6. The second diametrical passage 36 is located adjacent to the remote end 32 of the adjustable post 6 and the third diametrical passage 38 is located at a position axially between the proximate and remote ends 10, 32 of the adjustable post 6. Each of the first, second and third diametrical passages 34, 36, 38 extend laterally through the adjustable post 6, i.e., at right angles with respect to the longitudinal axis 20 of the adjustable post 6. As will be discussed in further detail below, the first diametrical passage 34 through proximate end 10 of the adjustable post 6 enables a fastener 40 of the pivoting joint assembly 12 to pass through the adjustable post 6 for the purpose of coupling the adjustable post 6 to the main pole 4. The third diametrical passage 38 through the adjustable post 6 enables a fastener 42 of the fixed coupler 18 to pass through the adjustable post 6 for coupling the bracing shaft 8 to the adjustable post 6. The second diametrical passage 36 facilitates securing the remote end 32 of the adjustable post 6 to foundation wall 22, as also discussed in further detail below.

For the sake of simplicity in manufacturing the temporary barrier post 2, the adjustable post 6 is formed from the same elongate hollow pipe as the main pole 4 discussed above. That is to say in other words, the adjustable post 6 has an outside diameter that is preferably between about 0.5 inches to 2.5 inches or more preferably the outside diameter of the adjustable post 6 is about 0.875 inches. The axial length of the adjustable post 6 generally depends on any official regulations regarding the distance at which the safety perimeter or control line 29, or more specifically the highly visible signaling means, safety tape, safety flags or signs 31 are to be spaced away from the foundation wall 22. Typically such signaling means are to be located at about 60 inches away from the foundation wall 22. Further considerations should also be given to the axial length of the bracing shaft 8 which couples the adjustable post 6 to another anchor bolt 22 and the local code or requirements regarding the spacing of anchor bolts 44 along the top of the foundation wall 22. Based on these, the axial length of the adjustable post 6 is preferably between about 48 inches to 72 inches or more preferably the axial length of the adjustable post 6 is about 60 inches.

As shown especially well in FIGS. 3-5, the proximate end 10 of the adjustable post 6 is coupled to the main pole 4 by means of the pivoting joint assembly 12. The pivoting joint assembly 12 includes a cylindrical sleeve 46. The sleeve 46 is slidably fitted on the main pole 4 such that the sleeve 46 is at least substantially collinear with the longitudinal axis 14 of the main pole 4. The main pole 4 passes through the sleeve 46 which can axially slide along the length of the main pole 4. An anchor 48 is integrally fixed to or formed together with the sleeve 46. The anchor 48 receives an elongate fastener 40 such as a rod, pin, peg, dowel or stud which is rigidly fixed to the anchor 48 in a manner such that it extends from the anchor 48 in a lateral direction away from the sleeve 46 and thus extends laterally away from the main pole 4. In another variation of the pivoting joint assembly 12, the anchor 48 can be formed as a nut which is secured to the sleeve 46 by means of a weld or the like. In this case the fastener 40 can be a threaded bolt or rod which can be screwed into and permanently fixed to the nut. The fastener 40 extends through the first diametrical passage 34 of the adjustable post 6 and has a head 50 located on the lateral side of the adjustable post 6 opposite from the anchor 48. The fastener head 50 functions to retain the adjustable post 6 on the fastener 40. It is to be appreciated that the fastener 40 has at least a slightly smaller outer diameter than the inner diameter of the first diametrical passage 34 of the adjustable post 6 such that the adjustable post 6 can pivot about an axis 52 of the fastener 40 relative to the sleeve 46 or rather the main pole 4. In order to stabilize pivoting movement of the adjustable post 6 relative to the main pole 4, one or more spacers 54, i.e., washers can be arranged between the laterally opposite outer sides of the adjustable post 6 and the corresponding fastener head 50 and anchor 48. As shown in FIGS. 3-5 the anchor 48 extends from the sleeve 46 and thereby forms a gap between the adjustable post 6 and the sleeve 46 or rather the main pole 4. This gap ensures that the adjustable post 6 does not contact or strike the main pole 4 as it pivots about the axis 52 of the fastener 40. Pivoting movement of the adjustable post 6 is however limited by means of a stop 56 that is rigidly fixed to the sleeve 46. The stop 56 is formed by a rod, pin, peg, dowel or stud and is positioned, as shown in FIGS. 3-5, on the sleeve 46 so as to be axially offset relative to the fastener 40. The stop 56 and the fastener 40 extend at least substantially from the sleeve 46 in the same direction parallel to each other and perpendicular to the sleeve 46 and the main pole 4. When the temporary barrier post 2 is arranged in the expanded or installed condition with the remote end 32 of the adjustable post 6 abutting the top surface of the foundation wall 22, the sleeve 46 will slide along the main pole 4 in a vertically downward direction, i.e., toward the foot 28 at the base end 30 of the main pole 4, and the adjustable post 6 will continue to pivot about the axis 52 of the fastener 40 until the adjustable post 6 abuts or rather contacts the stop 56. Due to the axially offset arrangement of the stop 56 relative to the fastener 40, the adjustable post 6 ceases pivoting movement when it is in a generally horizontal position, i.e., at a right angle with respect to the vertically arranged main pole 4. As the sleeve 46 can generally freely slide along the main pole 4, the combined weight of the pivoting joint assembly 12 and the adjustable post 6 can cause a continued stress to be placed on the stop 56.

To at least reduce or prevent continued stress on the stop 56, the sleeve 46 comprises a bore 58 and a connector 60 that is concentrically aligned with the bore 58 and integrally fixed to the sleeve 46 which together form a passage to the interior of the sleeve 46. The connector 60 can be formed from a nut which has a threaded interior surface and is fixed to the sleeve 46 by means of a weld or the like. A stay 62, such as a threaded rod or bolt, can be screwed into the connector 60 and through the passage until the leading end 64 of the stay 62 contacts the outer surface of the main pole 4. As can be appreciated, the stay 62 generally functions as a set screw to secure the sleeve 46 relative to the main pole 4. In order to facilitate gripping and rotation of the stay 62 within the passage, the trailing end 66 of the stay 62 can comprise a knob 68 or other type of handle. In a simple variation the stay 62 can be bent such that the trailing end 66 thereof is at an angle relative to the leading end 64. These measures help to apply a greater torque on the stay 62 and enhance or rather strengthen contact between the stay 62 and the main pole 4.

As briefly described above the adjustable post 6 generally functions to secure the main pole 4, i.e., the temporary barrier post 2 and safety perimeter or control line 29 at a set distance away from the foundation wall 22. For this purpose the remote end 32 of the adjustable post 6 can be placed on the foundation wall 22 such that the second diametrical passage 34 receives an anchor bolt 44 which extends generally vertically upward from the top surface of the foundation wall 22. With the anchor bolt 44 passing through the second diametrical passage 36 of the adjustable post 6, the temporary barrier post 2 can be moved such that the position of the main pole 4 or rather the distance between the main pole 4 and the edge of the foundation wall 22 can be changed by simply pivoting the adjustable post 6 about the anchor bolt 44. In order to fix or secure the position of the main pole 4 relative to the foundation wall 22, the temporary barrier post 2 comprises a bracing shaft 8 that has proximate and remote ends 16, 70. The proximate end 16 of the bracing shaft 8 is pivotally secured to the adjustable post 6 by means of the fixed coupler 18 whereas the remote end 70 of the bracing shaft 8 can be secured to another anchor bolt 44 that is set in the foundation wall 22.

For the sake of simplicity in manufacturing the temporary barrier post 2, the bracing shaft 8 is formed from the same elongate hollow pipe as the main pole 4 and adjustable post 6 as discussed above. That is to say in other words, the bracing shaft 8 has an outside diameter that is preferably between about 0.5 inches to 2.5 inches or more preferably the outside diameter of the bracing shaft 8 is about 0.875 inches. As discussed above the axial length of the bracing shaft 8 generally depends on the distance at which the safety perimeter or control line 29, is to be spaced away from the foundation wall 22, the spacing of anchor bolts 44 along the top of the foundation wall 22 as well as the axial length of the adjustable post 6. Based on these, the axial length of the bracing shaft 8 is preferably between about 30 inches to 50 inches or more preferably the axial length of the bracing shaft 8 is about 40 inches.

Figure 7:
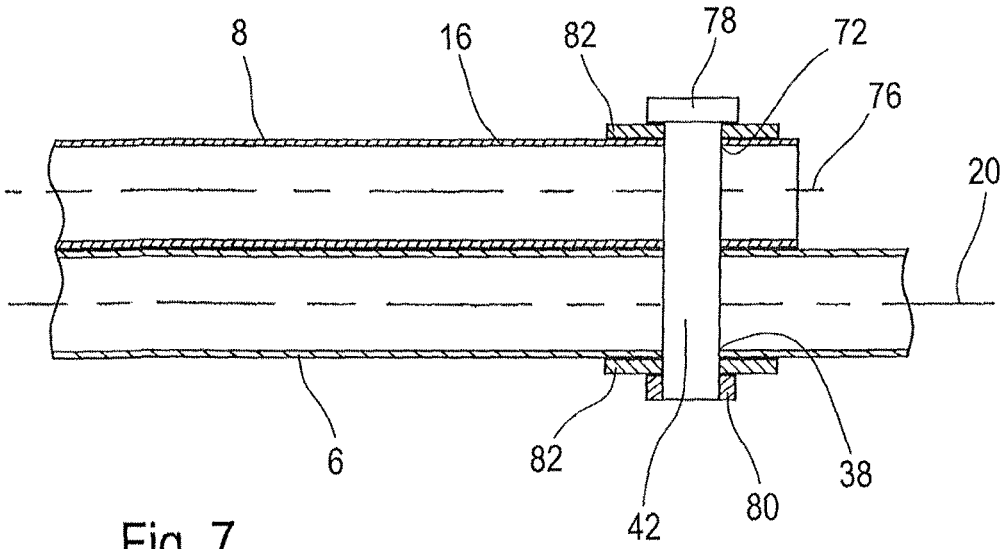
FIG. 7 is lateral section view of the fixed coupler according to the invention.
Figure 6:
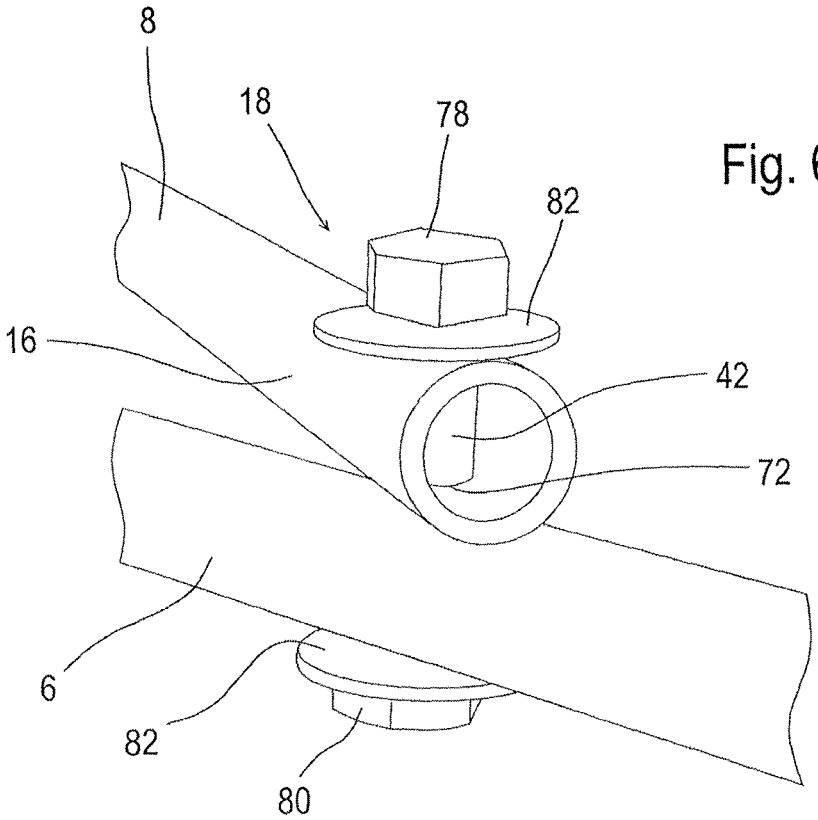
FIG. 6 is a perspective view of a fixed coupler according to the invention.

Similar to the proximate and remote ends 10, 32 of the adjustable post 6, the proximate and remote ends 16, 70 of the bracing shaft 8 are open (see FIGS. 6, 7), however is to be understood that the opposite proximate and remote ends 16, 70 of the bracing shaft 8 can also be closed by end caps (not shown) for example so as to prevent or reduce foreign matter, i.e., rain, dirt, sand and/or debris from entering the interior of the bracing shaft 8. Additionally as discussed above the bracing shaft 8 can be formed from a solid pole, post, shaft, rod, or bar, however it is to be appreciated that the drilling of the first and second diametrical passages 72, 74 through the bracing shaft 8 may by simplified if the bracing shaft 8 is hollow. For example, if the bracing shaft 8 is hollow then each of the first and the second diametrical passages 72, 74 can be formed by drilling two concentric apertures on opposite sides of the bracing shaft 8. The first diametrical passage 72 is located adjacent to the proximate end 16 of the bracing shaft 8 while the second diametrical passage 74 is located adjacent to the remote end 70 of the bracing shaft 8. Each of the first and the second diametrical passages 72, 74 extend laterally through the bracing shaft 8, i.e., along axes that are at right angles with respect to a longitudinal axis 76 of the bracing shaft 8. The fastener 42 of the fixed coupler 18 passes through the first diametrical passage 72 of the bracing shaft 8 and the third diametrical passage 38 of the adjustable post 6 so as to couple the bracing shaft 8 and the adjustable post 6 to each other in a pivotable manner. The fastener 42 can be a threaded rod or bolt have a head 78 located on an axial end thereof. A nut 80 can be screwed onto to the end of the fastener 42 opposite the head 78 for the purpose of coupling the bracing shaft 8 to the adjustable post 6. The nut 80 is tightened on the fastener 42 with the adjustable post 6 and the bracing shaft 8 being arranged between the head 78 of the fastener 42 and the nut 80. In order to facilitate pivoting movement of the bracing shaft 8 relative to the adjustable post 6, one or more spacers 82 or rather washers can be arranged between the adjustable post 6 and the nut 80 as well as between the bracing shaft 8 and the fastener head 78. Although FIGS. 6 and 7 show the bracing shaft 8 and the adjustable post 6 being in contact with one another, it is to be appreciated that one or more spacers, i.e., washers can be arranged between the bracing shaft 8 and the adjustable post 6.

The second diametrical passage 74 of the bracing shaft 8 serves the same purpose as the second diametrical passage 34 of the adjustable post 6. Generally the second diametrical passage 74 of the bracing shaft 8 facilitates securing the remote end 70 of the bracing shaft 8 to the foundation wall 22. As the second diametrical passage 74 of the bracing shaft 8 is substantially identical to the second diametrical passage 34 of the adjustable post 6, a detailed description regarding the same is not believed to be necessary. It is to be appreciated however that the remote ends 32, 70 of the adjustable post 6 and the bracing shaft 8 are coupled to different anchor bolts 44 so as to fix the adjustable post 6 at two different points along the length of the adjustable post 6. Specifically, the adjustable post 6 is fixed relative to the foundation wall 22 at the second diametrical passage 34 as well as at the third diametrical passage 38. In this manner the location or rather the distance of the main pole 4 away from the foundation wall 22 becomes fixed and generally can not be inadvertently changed.

Figure 8:
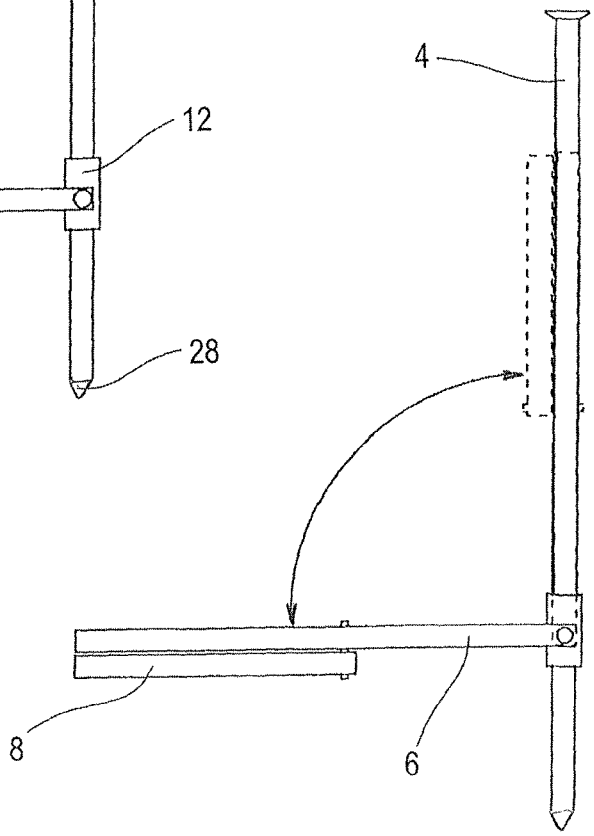
FIG. 8 is a diagrammatic elevation view of the temporary barrier post according to the invention showing pivoting movement of an adjustable post with respect to the main pole.

The manner of assembling or forming a safety perimeter or control line 29 relative to a foundation wall 22 will now be described in relation to switching or changing the temporary barrier post 2 from the collapsed or stowed position to the expanded or installed condition, as shown in FIG. 2 to the expanded or installed condition as shown in FIG. 1. Although the following will describe installing a single temporary barrier post 2, it is to be understood that a safety perimeter or control line 29 around a foundation wall 22 typically includes installing a system or a number of temporary barrier posts 2. Initially the temporary barrier post 2, generally in the stowed or collapsed condition, is brought to the approximate location of the safety perimeter or control line 29 around the foundation wall 22. With the temporary barrier post 2 in the collapsed or stowed condition, the foot 28 of the main pole 4 can be placed on the ground such that the main pole 4, the adjustable post 6 and the bracing shaft 8 are generally vertical relative to the ground. At this point, the adjustable post 6 can pivoted in both directions about the fastener 40 of the pivoting joint assembly 12 until the adjustable post 6 abuts the stop 56 and further pivoting of the adjustable post 6 is prevented. The adjustable post 6 generally abuts the stop 56 when it is at least substantially aligned at a right angle with respect to the main pole 6. Pivoting movement of the adjustable post 6 relative to the main pole 4 is diagrammatically illustrated in FIG. 8.

Figure 9:
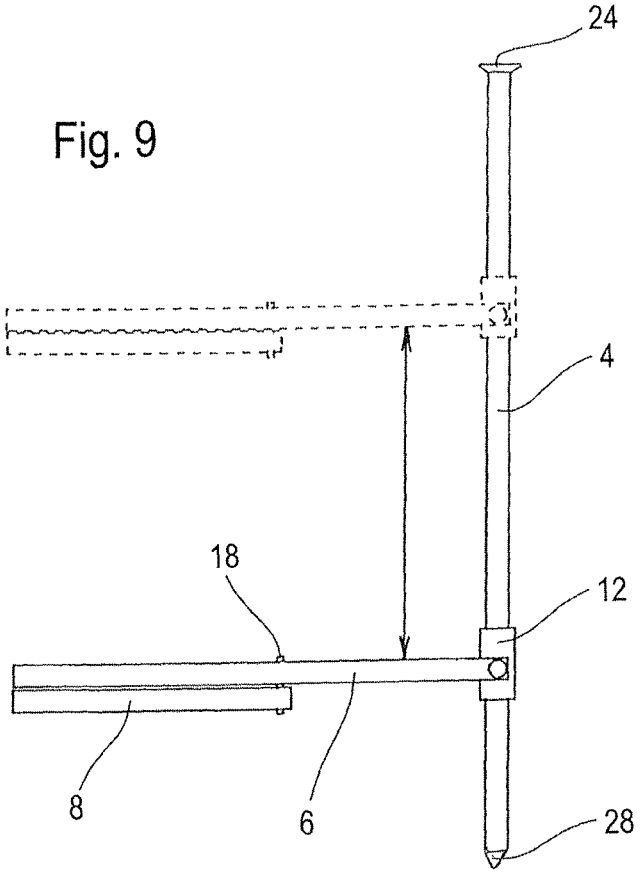
FIG. 9 is a diagrammatic elevation view of the temporary barrier post according to the invention showing sliding movement of the slidable pivoting joint assembly along a main pole.
Figure 10:
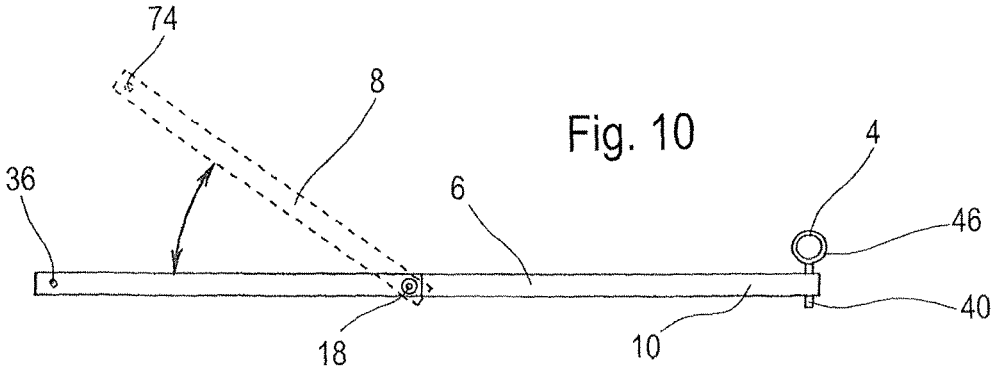
FIG. 10 is a diagrammatic top view of the temporary barrier post according to the invention showing pivoting movement of the bracing shaft with respect to the adjustable post.

With the adjustable post 6 extending substantially horizontally from the main pole 4 and the stay 62 is not in contact with the outer surface of the main pole 4, the sleeve 46 can slide axially along the main pole 4. In this manner the vertical height of the adjustable post 6 is adjusted by sliding the slidable, pivoting joint assembly 12 up or down along the axial length of the main pole 4, as diagrammatically shown in FIG. 9, until the vertical height of the adjustable post 6 is about the same height as the top surface of the foundation wall 22. From this position it is possible to either fix the position of the pivoting joint assembly 12 along the main pole 4 or couple the remote ends 32, 70 of the adjustable post 6 and bracing shaft 8 to the foundation wall 22. To fix or secure the position of the pivoting joint assembly 12 along the main pole 4, the stay 62 is twisted or rotated such that the leading end 64 of the stay 62 engages the outside surface of the main pole 4. To couple the remote ends 32, 70 of the respective adjustable post 6 and bracing shaft 8 to the foundation wall 22, the bracing shaft 8 can be pivoted about the fastener 42 of the fixed coupler 18 relative to the adjustable post 4 such that the remote ends 32, 70 thereof are spaced at a distance away from each other, as shown in FIG. 10. When appropriately pivoted from the adjustable post 4, the second diametrical passage 74 at the remote end 70 of the bracing shaft 8 is positioned to receive an anchor bolt 44 on the foundation wall 22. Similarly the second diametrical passage 34 at the remote end 32 of the adjustable post 4 is positioned to receive an adjacent anchor bolt 44 on the foundation wall 22.

When the remote ends 32, 70 of the adjustable post 6 and the bracing shaft 8 are secured to the foundation wall 22 with the anchor bolts 44 extending through the corresponding second diametrical passages 36, 74 and when the position of the pivoting joint assembly 12 is fixed, via the stay 62, on the main pole 4, the temporary barrier post 2 is considered to be installed or set in position relative to the foundation wall 22.

After a system or number of other temporary barrier posts 2 have been installed or set in position around the outside of the foundation wall 22 in the same manner as just described, the safety perimeter or control line 29 can be set up. To set up or form the safety perimeter or control line 29, highly visible signaling means, safety tape, safety flags or signs 31 are wrapped around, tied or otherwise secured to each of the main poles 4 of the temporary barrier posts 2 at the desired vertical height. It is to be recognized that the vertical height at which the highly visible signaling means, safety tape, safety flags or signs 31 may depend on local, state or national safety codes and/or regulations.

The process for disassembling the safety perimeter or control line 29 are essentially the same as described above for assembling or forming the safety perimeter or control line 29 but in reverse. As such, disassembly of the safety perimeter or control line 29 and switching or changing the temporary barrier post 2 from the expanded or installed condition to the collapsed or stowed position is not believed to be necessary.

It is to be appreciated that various modifications and alterations of the above described invention will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a imitative sense.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

I claim:

1. A temporary barrier post comprising:

a main pole, an adjustable post, and a bracing shaft;

a joint assembly which is supported on the main pole such that the joint assembly is axially slidable along the main pole, a proximate end of the adjustable post being rotationally connected to the joint assembly such that the adjustable post is rotatable with respect to the joint assembly;

a coupler that is fixed to the adjustable post axially between the proximate end of the adjustable post and a remote end of the adjustable post, a proximate end of the bracing shaft being connected, via the coupler, to the adjustable post such that the bracing shaft is pivotable with respect to the adjustable post;

the temporary barrier post being adjustable between an expanded condition and a collapsed condition, in the collapsed condition of the temporary barrier post, the main pole, the adjustable post, and the bracing shaft are at least substantially parallel to each other, and in the expanded condition of the temporary barrier post, the adjustable post extending laterally relative to the main pole, the bracing shaft being oblique relative to the adjustable post, and the adjustable post and the bracing shaft retaining the main pole in a set location via the joint assembly.

2. The temporary barrier post according to claim 1, wherein the joint assembly having a stay that releasably abuts the main pole fixing the joint assembly axially relative to the main pole, and a stop being fixed to and extending from the joint assembly preventing rotational movement of the adjustable post relative to the joint assembly when the adjustable post abuts the stop.

3. The temporary barrier post according to claim 1, wherein the joint assembly comprises a sleeve through which the main pole extends and facilitates axial sliding of the joint assembly along the main pole, the joint assembly comprising a fastener that is connected to the sleeve and extends laterally from the sleeve in a first direction, a stop being fixed to and extending laterally from the sleeve in the first direction such that the fastener and the stop are substantially parallel to each other, the fastener connecting the proximate end of the adjustable post to the joint assembly such that the adjustable post rotates about the fastener, and the stop being arranged such that the adjustable post contacts the stop when the adjustable post extends laterally relative to the main pole.

4. The temporary barrier post according to claim 3, wherein the proximate end of the adjustable post having a first diametrical passage that extends through the adjustable post, the fastener having one end that is fixed to the sleeve and the fastener extends through the first diametrical passage in the adjustable post, and an opposite end of the fastener having a head which retains the adjustable post on the fastener.

5. The temporary barrier post according to claim 3, wherein the joint assembly having a stay that is adjustable relative to the sleeve between an engaged position and a disengaged position, and the stay in the engaged position extends through the sleeve and abuts the main pole preventing sliding of the joint assembly along the main pole, and in the disengaged condition, the stay is spaced from the main pole facilitating axial sliding movement of the joint assembly along the main pole.

6. The temporary barrier post according to claim 5, wherein a threaded connector being fixed to the sleeve and the threaded connector being aligned with a bore in the sleeve, and the stay having a threaded end which mates with the threaded connector such that rotation of the stay relative to the connector biases the stay between the engaged and the disengaged positions, the stay in the engaged position passing through the bore in the sleeve and abutting the main pole fixing the joint assembly relative to the main pole.

7. The temporary barrier post according to claim 1, wherein the joint assembly comprising a cylindrical sleeve, which is coaxially aligned with the main pole, and a fastener having an axial end that is rigidly fixed to an outer surface of the sleeve such that the fastener extends laterally relative to the sleeve and the main pole, the proximate end of the adjustable post having a first diametrical passage which receives the fastener, the adjustable post being rotatable about the fastener relative to the sleeve and the main pole, the remote end of the adjustable post having a second diametrical passage and a third diametrical passage, the proximate end of the bracing shaft having a first diametrical passage and a remote end of the bracing shaft having a second diametrical passage, the coupler extending through the third diametrical passage of the adjustable post and the first diametrical passage of the bracing shaft connecting the proximate end of the bracing shaft to the adjustable post, the bracing shaft being pivotable with respect to the adjustable post about the coupler such that the remote end of the bracing shaft is laterally spaced from the remote end of the adjustable post.

8. The temporary barrier post according to claim 7, wherein the second diametrical passage of the bracing shaft and the second diametrical passage of the adjustable shaft receive a respective anchor which are fixed in position relative to the set location such that the main pole extends in a vertically relative to the bracing shaft and the adjustable post which extend horizontally.

9. A temporary barrier post comprising:

a main pole, an adjustable post, and a bracing shaft;

a joint assembly which is supported on the main pole such that the joint assembly is axially slidable along the main pole, a proximate end of the adjustable post being pivotably connected to the joint assembly such that the adjustable post is rotatable with respect to the joint assembly, the joint assembly having stay which releasably abuts the main pole and fixes the joint assembly along an axis of the main pole, the joint assembly having a stop which stops pivoting movement of the adjustable post relative to the joint assembly when the adjustable post is laterally arranged relative to the main pole;

a coupler being fixed to the adjustable post axially between the proximate end of the adjustable post and a remote end of the adjustable post, a proximate end of the bracing shaft being connected, via the coupler, to the adjustable post such that the bracing shaft is pivotable with respect to the adjustable post;

the temporary barrier post being adjustable between an expanded condition and a collapsed condition, in the collapsed condition of the temporary barrier post, the main pole, the adjustable post, and the bracing shaft are at least substantially parallel to each other, and in the expanded condition of the temporary barrier post, the adjustable post abuts the stop and extends substantially perpendicular relative to the main pole and the bracing shaft is oblique relative to the adjustable post, and the adjustable post and the bracing shaft retaining the main pole in a set location via the joint assembly.

10. The temporary barrier post according to claim 9, wherein the joint assembly comprises a cylindrical sleeve through which the main pole extends such that the cylindrical sleeve and the main pole are coaxial and the sleeve facilitates axial sliding movement of the joint assembly along the main pole, the joint assembly comprising a fastener that is connected to the sleeve and extends laterally from the sleeve in a first direction, the fastener passes through apertures in the proximate end of the adjustable post such that the adjustable post is pivotable about the fastener relative to the joint assembly.

11. The temporary barrier post according to claim 10, wherein the stop being fixed to and extending laterally from the sleeve in the first direction such that the fastener and the stop are parallel to each other, and the stop being arranged such that the adjustable post abuts the stop when the adjustable post extends perpendicular relative to the main pole.

12. The temporary barrier post according to claim 10, wherein the remote end of the adjustable post and a remote end of the bracing shaft have passages that receive fixed securing elements such that the bracing shaft, the adjustable shaft and the joint assembly are fixed in position relative to the securing elements.

13. The temporary barrier post according to claim 12, wherein the passages at the remote ends of the adjustable post and the bracing shaft receive anchor bolts that end from a foundation wall.

14. A method of arranging a temporary barrier post to form a barrier at a set distance from a structure, the method comprising:

positioning the temporary barrier post relative to the structure, the temporary barrier post having a main pole, an adjustable post, and a bracing shaft, the adjustable post being pivotably and slidably connected, via a joint assembly, to the main pole, and the bracing shaft being pivotally connected, via a coupler, to the adjustable post;

adjusting the temporary barrier post from a collapsed condition to an expanded condition by arranging the temporary barrier post vertically such that in the collapsed condition each of the main pole, the adjustable post, and the bracing shaft extend vertically, pivoting the adjustable post about the joint assembly relative to the main pole such that the adjustable post is perpendicular to the main pole, pivoting the bracing shaft about the coupler relative to the adjustable post such that the bracing shaft is at an oblique angle relative to the adjustable post, sliding the joint assembly axially along the main pole such that a vertical height of the adjustable post is at least substantially equal to a vertical height of the structure;

fixing the joint assembly to the main pole to secure the adjustable post to the main pole; and arranging the adjustable post and the bracing shaft such that an aperture in a remote end of the adjustable post opposite the joint assembly receives an anchor fixed to the structure, and such that an aperture in a remote end of the bracing shaft opposite the coupler receives another anchor fixed to the structure.

15. The method according to claim 14, further comprising receiving a fastener fixed to the joint assembly within a passage of the adjustable post such that the adjustable post is connected to the joint assembly and pivotable about the fastener relative to the joint assembly and the main pole.

16. The method according to claim 14, further comprising adjusting a stay of the joint assembly to engage the main pole and fix the joint assembly to the main pole and secure the adjustable post to the main pole.

* * * * *